US005887606A

United States Patent [19]

Tsou

[11] Patent Number: 5,887,606

[45] Date of Patent: Mar. 30, 1999

[54] PURIFYING DEVICE FOR CLEANING COMBUSTION CHAMBER OF CAR ENGINE

[76] Inventor: John Tsou, 10th Floor, No.1, La. 76, Su Wei Rd., Taipei, Taiwan

[21] Appl. No.: 963,823

[22] Filed: Nov. 4, 1997

[30] Foreign Application Priority Data

Jun. 24, 1997 [TW] Taiwan ..... 86210434

[51] Int. Cl.[6] ..... B08B 9/00

[52] U.S. Cl. ..... 134/166 R; 134/169 A; 134/168 R; 123/198 A

[58] Field of Search ..... 134/166 R, 169 A, 134/168 R, 169 C, 168 C; 123/198 A

[56] References Cited

U.S. PATENT DOCUMENTS

| | | | |
|---|---|---|---|
| 2,454,585 | 11/1948 | Alderman | 134/169 A |
| 4,109,703 | 8/1978 | Babish et al. | 134/169 A |
| 4,127,160 | 11/1978 | Joffe | 134/169 A |
| 5,063,896 | 11/1991 | Hyatt et al. | 123/198 A |
| 5,566,781 | 10/1966 | Robert et al. | 134/169 A |

*Primary Examiner*—Frankie L. Stinson

[57] ABSTRACT

The present invention relates to a purifying device for cleaning the nozzle of combustion chamber of car engine and carbon accumulated in the valve, which is to use an inlet tube connecting fuel oil pump of car for feeding fuel oil into a provision oil reservoir and mixing with an additive. An oil pump of the present invention is connected with the car power supply and starting oil pump, and a solution of oil and additive extracted from the oil reservoir are fed into an oil spraying system by a filter for cleaning the nozzle and valve. The oil spraying system has an oil return tube for returning a part of the oil back into the provision oil reservoir for cycling use. The operation of the present invention is conducted when the car is operating so oil fed by the car oil pump will fill up the provision oil reservoir and will return to the oil reservoir through the oil return tube after the switchover of oil pressure controller so as to achieve the purpose of purifying the engine combustion chamber without affecting normal operation of car.

7 Claims, 3 Drawing Sheets

PURIFYING DEVICE FOR CLEANING COMBUSTION CHAMBER OF CAR ENGINE

BACKGROUND OF THE INVENTION

The present invention relates to a purifying device for cleaning a combustion chamber of a car engine, which relates to additive of proper ratio spraying in association with fuel oil out of oil spraying system effectively to clean up the choke and valve carbon on the nozzle.

The birth of car has given the convenience of traffic for the human being but it also has produced exhaust gas everywhere to destroy the environment; it is widely known that, car exhaust gas is resulted from incomplete combustion factors, including oil-air ratio, in oil quality, engine structure, servicing problem and driving habit; of which with regard to oil quality, it is the main cause of waste gas emission by the car. As indicated by the research of the experts, during the refinery of oil, certain substances are not effectively dissolved to result in harmful substances during combustion, and these harmful substances will be discharged into the air through the exhaust tube and also accumulated in the valve and piston top of combustion chamber to result in carbon accumulation; owing to co-existence of carbon accumulation in the chamber, the cause of waste gas and pollution in the combustion chamber of engine is absolutely related to it.

As a chemical ingredient of oil is mainly accounted for the pollution in the combustion chamber of engine, the way of improvement is to request China Oil Corporation for adding certain cleaning agent in the refinery process of petroleum oil so as to reduce carbon accumulation in the combustion chamber of engine; however, such idea has involved in major oil product manufacturing process and product cost, and therefore, it is not likely to be realized in short period; if it is to dismount the cylinder for clearing accumulated carbon, it will be too complicated and the cost is too high and also it is liable to cause car damage; the method for resolving cabon pollution in the combustion chamber of engine in the car industry mostly lies in adding certain chemical in oil product so as to clear up accumulated carbon in the engine.

On the current market, most of combustion chamber cleaning additive are directly thrown in the oil reservoir or driven into it by using compressed air or AC motor pump; the methods of adding it into the oil reservoir, in fact, create a number of defects, for instance:

1. As to direct throwing in, mix ratio of additive to oil can not be precisely controlled as result of different oil volume in the oil reservoir to affect cleaning effect in the combustion chamber.
2. To use compressed air for driving additive, except for the above-mentioned problem, the most difficulty lies in the source of compressed air not easily made available for it is usually a fixed air source and not convenient to operate; another, the use of compressed air for driving additive, system pressure shall be reduced for adding or replacing chemical each time, and practically speaking it is not convenient and hazardous; furthermore, as compressed air adopts close pipeline, it lacks oil return pipeline design, so it can not be used for cleansing CIS-E type oil spraying system; and there will be some dead corners not possible for cleansing for the other oil spraying systems.
3. To use AC motor for pumping additive, the biggest trouble lies in source of power supply; as the operation of car adopts DC power generation, the use of AC power for pumping additive, in fact, can not be carried out anytime and anywhere; and AC motor has very weak resistance against chemical property of additive.

SUMMARY OF THE INVENTION

In view of aforesaid defects arising from filling additive into the oil pipeline for cleansing the combustion chamber of engine, the inventor thus has devoted himself to developing an auxiliary device which has a provision oil reservoir and affiliated facilities such as oil pump, oil filter, etc.; an oil intake tube and oil tube of said device connecting to the provision oil reservoir are connected to car fuel oil pump and oil reservoir, and another oil outlet tube and oil return tube are connected to oil spraying system of car; when starting oil spraying system of car, as the provision oil reservoir of the device has oil and additive solution of proper mix ratio, it may be continued to be pumped into the oil spraying system by means of 12 V oil pump, for cleansing the combustion chamber and return flow of solution from the oil spraying system to the provision oil reservoir for cycling use; the device can be suitable for the car with different type of oil spraying system, and its use may need only power supply of the car itself without problem arising from restriction to type of car and power supply.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENT

Figure 1:
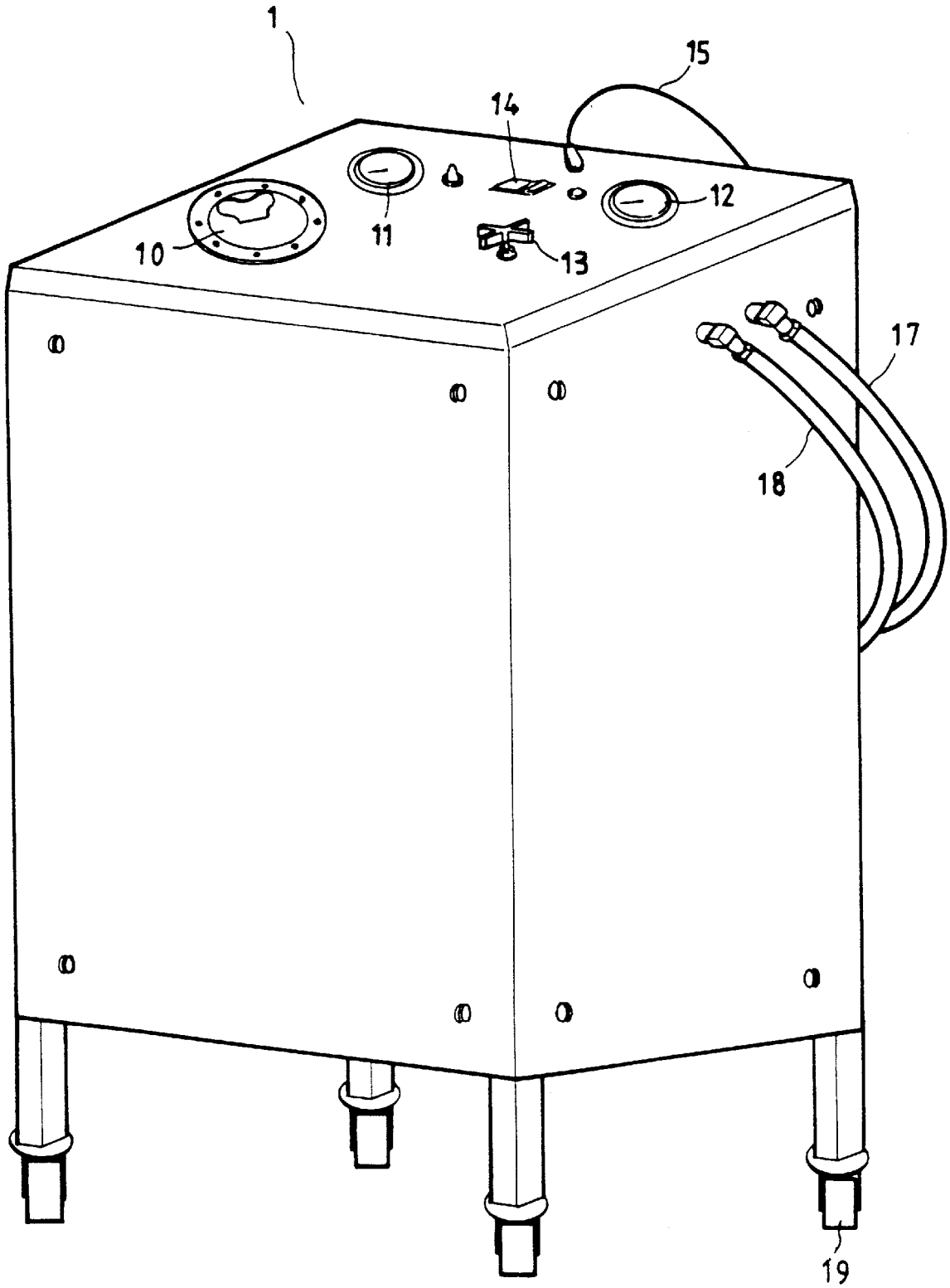
FIG. 1 is an elevational diagram of external structure of the present invention.

Referring to FIG. 1, the top cover of outer case 1 having an oil lid 10, oil intake pressure gauge 11, outlet pressure gauge 12, function selection button 13, oil pump start switch 14 and a power cord 15, and two sides of outer case 1 having an outlet tube 17, oil intake tube 17*a* and two pairs of oil return tube 18, 18*a* (wherein oil intake tube 17*a*, oil return tube 18*a* not shown). The present outer case 1 has four rollers 19 to facilitate movement.

Figure 2:
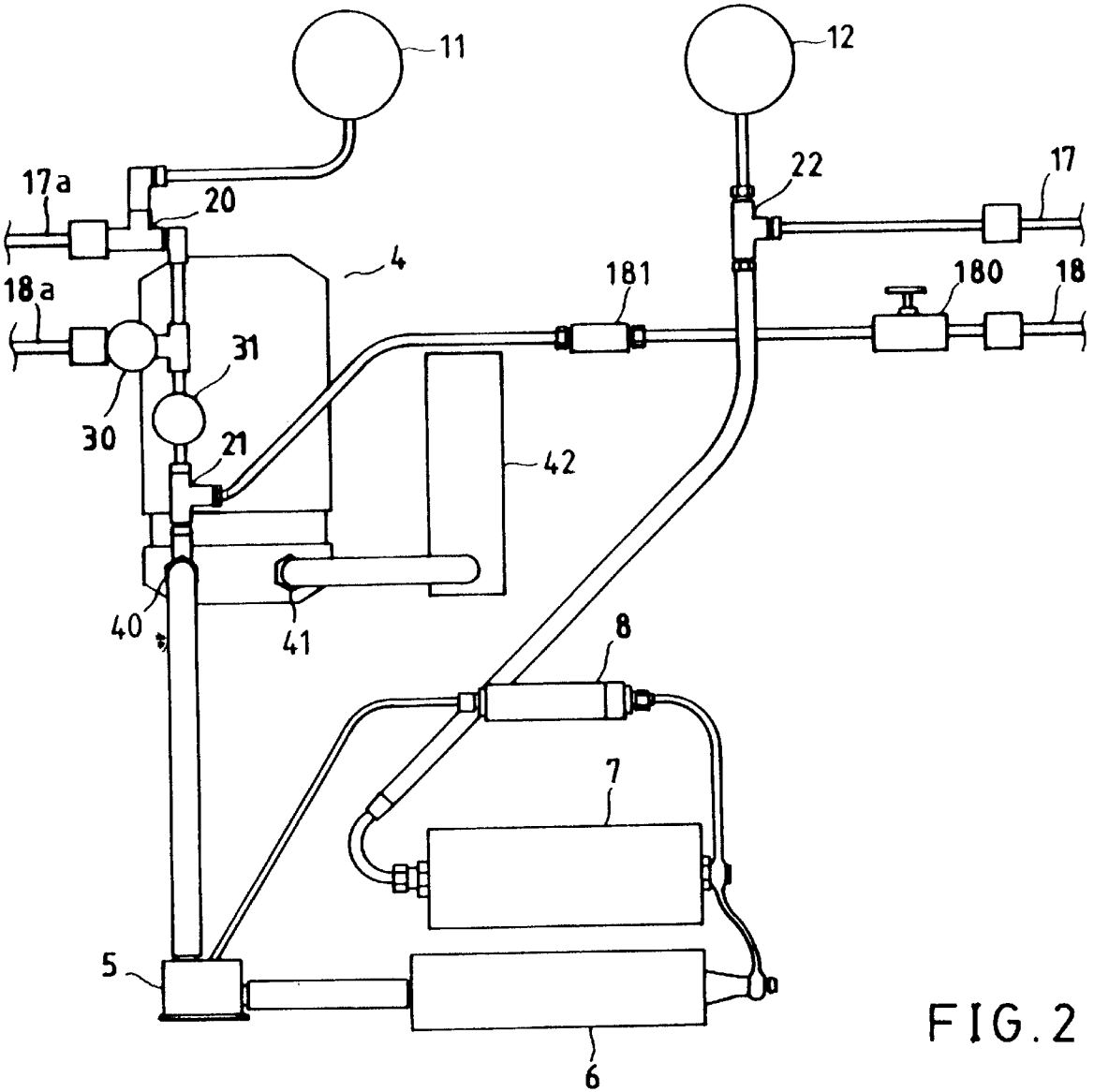
FIG. 2 is a schematic drawing of the internal pipeline of the present invention.

Referring to FIG. 2, the oil inlet tube 17*a* on one side of said outer case 1 uses a 3-pass joint 20 upwardly connecting to oil pressure gauge 11 and downwardly connecting a pair of flow switch valves 30, 31, wherein the first flow switch valve 30 is connected left-handed to the oil return tube 18*a*, and the second flow switch valve 31 is downwardly connected to a 3-pass joint 21 and further to oil inlet/outlet 40 of the provision oil reservoir 4: oil inlet/outlet 40 of the provision oil reservoir 4 is downwardly connected to a transit oil tank 5 and right-handed connected to an oil pump 6 from the oil tank, and the oil pump 6 is upwardly connected to a filter 7 and high-pressure release valve 8; wherein, the filter 7 is upwardly connected to a 3-pass joint 22 and oil outlet pressure gauge 12, and high-pressure release valve 8 is downwardly connected to the transit oil tank 5; the 3-pass joint 22 under the oil pressure gauge 12 is right-handed connected to the outlet tube 17 of the outer case; the oil return tube 18 of outer case is right-handed connected to the flow control valve 180 and further to a one-way valve 181, and finally connected to the 3-pass joint 21 of the provision oil reservoir 4; an oil test port 41 is horizontally mounted on the provision oil reservoir 4 and oil inlet/outlet 40 for connecting a hydraulic controller 42.

Figure 3:
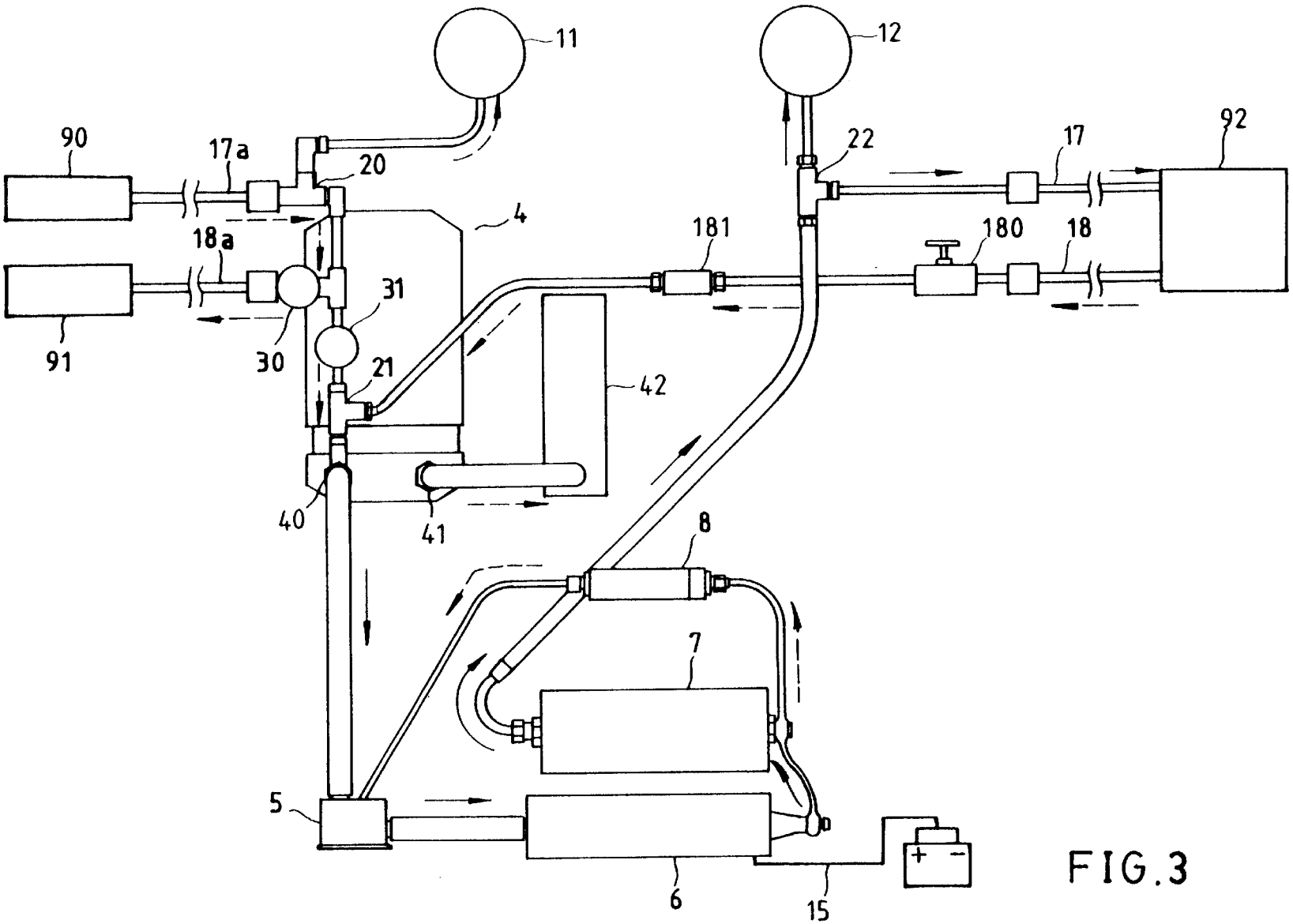
FIG. 3 is an operating principle diagram of the present invention.

Referring to FIG. 3, the oil inlet tube 17*a* is connected to fuel oil pump 90 of car, and oil return tube 18*a* is connected to the oil reservoir 91 of car; another, the oil outlet tube 17 is connected to oil spraying system 92 of car, and the end of oil spraying system 92 is connected to oil return tube 18; such connection method is characterized by: the original oil pipeline of ca is directly connected to the oil spraying system 92 from the fuel oil pump 90; fuel oil pump 90 of car is thus to feed oil into the oil spraying system 92 for spraying out of the nozzle to make engine piston operating to produce dynamic energy, and residual oil not consumed will return into the oil reservoir 91 of car through the pipeline; the present invention is to form an interception in the oil system of car and properly to make an effective connection between the cut-off fuel oil pump, oil reservoir and oil spraying system; when oil spraying and oil supply system of car is started, the car may be maintained in normal operation of each system.

Referring to FIG. 3, during the initial period of operation, the car shall be started, and power cord 15 shall be connected to car's 12 V power supply, and function selection button 13 on the outer case 1 shall be switched to "oil in" position, and the first flow switch valve 30 appears close, and the second flow switch valve 31 appears open; the fuel oil pump 90 is to pump oil into the provision oil reservoir 4 through the oil inlet tube 17*a* and the second switch valve 31 for mixing with the additive in the reservoir; when oil level has reached the preset height in the reservoir, the hydraulic controller 42 will shut off the second flow switch valve 31 and open the first flow switch valve 30 to let oil not to be filled in the provision oil reservoir 4 but return to the oil reservoir 91 of car, and at this moment, the provision oil reservoir 4 has stored solution by mixing of oil and additive at fixed quantity.

Referring to FIG. 3, upon completion of filling fuel oil of appropriate quantity into the provision oil reservoir 4, switch the function selection button 13 to "operation" position, and confirm the power cord 15 of outer case 1 must be connected with the car lighter or battery so as to provide 12 V power supply for the oil pump 6; and then push down the oil pump start switch 14, oil pump 6 begins to run and deliver the solution from the provision oil reservoir to the oil tube 17 and into the oil spraying system 92 through the filter 7 and 3-pass joint 22 and is sprayed out of the nozzle of oil spraying system 92, and action with valve (at the moment the car is operating), it may thoroughly clean the nozzle and valve in the combustion chamber; when cleaning said combustion chamber, oil return will be produced from the oil spraying system 92 to deliver the solution back into the provision oil reservoir 4 through the oil return tube 18 for cycling use; another, during the operating process, the present invention may observe it from oil inlet pressure gauge 11 and outlet pressure gauge 12 to know the operating pressure in the system is normal or not so as to attain the purpose of self-inspection, and to properly adjust oil spraying system pressure to fit oil spraying pressure of the car of the original model; another, the high pressure release valve 8 will automatically open to lead the solution into the transit oil tank 5 and cut off power supply when pipeline pressure is rising as result of filter 7 choking so as to avoid damage to the oil spraying system 92 due to idle run without solution supply; another safety measure of the present invention is to detect oil volume in the provision oil reservoir 4 by means of oil pressure controller 42, when oil volume is lower than ⅓ level, oil pump 6 can not be started so as to protect it from burning down due to idle run; the oil pressure controller 42 can also cut off power supply at right time when pressure is changing greatly due to oil line leakage.

The present invention is to mount the device between the fuel oil pump, oil reservoir and oil spraying system of car to reach the purpose of cleaning the carbon accumulated in the valve and nozzle choking.

It has the following characteristics:

1. Oil in and out are respectively controlled by different pipeline systems to ensure accuracy of pressure and have pressure self-inspection ability without relying on any other tool.
2. Oil pressure controller and high pressure release valve design may increase safety and reduce the risk of oil pump burning-down and oil spraying system idle run due to man-made error.
3. The provision oil reservoir may regulate the concentration of solution to make combustion chamber cleaning effect substantially.
4. Direct feeding fuel oil from oil pump into the provision oil reservoir for mixing, and automatic stop of oil supply upon full feeding to avoid solution leakage to cause damage to car body paint or engine.
5. With oil inlet and return system to be compatible with the engine and oil supply system of various types of car so that it may clean diesel car, carburetor car and any type of oil spraying system.
6. Full-mechanical control mode without complicated computer design to make easy for servicing.
7. Power source of oil pump directly comes from electric power of car without problem of power source and compressed air source.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A purifying device for cleaning a combustion chamber of a car engine, the purifying device comprising:

a provision oil reservoir, an oil pump, a filter, a high pressure release valve and an oil pressure controller;

an inlet/outlet port under the provision oil reservoir;

a first three-pass joint being connected to the inlet/outlet port of the provision oil reservoir and to a second flow switch valve;

a second three-pass joint being connected to a first flow switch which is connected a first oil return tube, the second three-pass joint also being connected to the second flow switch valve;

a third three-pass joint, the third three-pass joint being connected to the second three-pass joint;

an oil pressure gauge being connected to the third three-pass joint;

an inlet tube being connected to the third three-pass joint such that the third three-pass joint is connected to the second three-pass joint, the oil pressure gauge and the inlet tube;

a transit oil tank being connected to the inlet/outlet port of the provision oil reservoir;

the oil pump being connected to the transit oil tank, the filter and the high pressure release valve;

the high pressure release valve being connected to the transit oil tank;

a fourth three-pass joint, the filter being connected to the fourth three-pass joint;

an outlet gauge being connected to the fourth three-pass joint;

an outlet tube being connected to the fourth three-pass joint such that the fourth three-pass joint connects the filter, the outlet pressure gauge and the outlet tube;

a second oil return tube being connected to a flow control valve which is connected to a check valve which is connected to the first three-pass joint;

an oil inspection port being provided on the provision oil reservoir on a same level as the inlet/outlet port, the oil inspection port connecting the provision oil reservoir to the oil pressure controller;

during operation of the device, the inlet tube being connected to a fuel oil pump of a car, the outlet tube being connected to an oil spraying system of the car and the first and second oil return tubes being connected respectively to the oil reservoir and oil spraying system of the car; and additionally during operation of the car, a power supply for the device being connected to a power supply of the car.

2. The purifying device as recited in claim 1, wherein the second flow switch valve is above the first three-pass joint, the inlet/outlet port of the provision oil reservoir is under the first three-pass joint and a connection with the check valve, flow control valve and second oil return tube being on a side of the first three-pass joint.

3. The purifying device as recited in claim 1, wherein the second three-pass joint is below the third three-pass joint, to a side of the first flow switch valve and above the second flow switch valve.

4. The purifying device as recited in claim 1, wherein the third three-pass joint is below inlet oil pressure gauge, to a side of the inlet tube and above the second three-pass joint.

5. The purifying device as recited in claim 1, wherein the transit oil tank is below the inlet/outlet port of the provision oil reservoir and to a side of the oil pump and below the high pressure release valve.

6. The purifying device as recited in claim 1, wherein the filter is above the oil pump and below the high pressure release valve, the filter being upwardly connected to the fourth three-pass joint.

7. The purifying device as recited in claim 1, wherein the fourth three-pass joint is below the outlet pressure gauge, to a side of the outlet tube and above the filter.

* * * * *